United States Patent [19]

Zoleski et al.

[11] Patent Number: 4,720,350

[45] Date of Patent: Jan. 19, 1988

[54] OXIDATION AND CORROSION INHIBITING ADDITIVES FOR RAILWAY DIESEL CRANKCASE LUBRICANTS

[75] Inventors: Benjamin H. Zoleski, Beacon; Rodney L. Sung, Fishkill; Ronald L. O'Rourke, Hyde Park, all of N.Y.

[73] Assignee: Texaco Inc., White Plains, N.Y.

[21] Appl. No.: 851,617

[22] Filed: Apr. 14, 1986

[51] Int. Cl.[4] ..... C10M 129/00

[52] U.S. Cl. ..... 252/51.5 A; 252/51.5 R

[58] Field of Search ..... 252/51.5 A, 51.5 R

[56] References Cited

U.S. PATENT DOCUMENTS

| | | | |
|---|---|---|---|
| 3,184,474 | 5/1965 | Cattu et al. | 252/51.5 A |
| 3,281,356 | 10/1966 | Colemer et al. | 252/32.7 |
| 3,331,776 | 7/1967 | Krukziener et al. | 252/56 |
| 4,219,431 | 8/1980 | Chibnik | 252/51.5 A |
| 4,329,249 | 5/1982 | Fursherg | 252/51.5 A |
| 4,522,736 | 6/1985 | Andress et al. | 252/51.5 A |
| 4,579,674 | 4/1986 | Schlicht | 252/51.5 A |

*Primary Examiner*—William R. Dixon, Jr.
*Assistant Examiner*—Cynthia A. Prezlock
*Attorney, Agent, or Firm*—Robert A. Kulason; James J. O'Loughlin; Vincent A. Mallare

[57] ABSTRACT

A railway diesel crankcase lubricating oil composition for railway diesel engines, containing a mineral lubricating oil, an overbased calcium alkylphenolate and an alkyaryl sulfonate oxidation and corrosion inhibiting amount of a reaction product of alpha-hydroxy omega hydroxy-poly (oxyethylene) poly (oxypropylene) poly (oxyethylene) block copolymer, dibasic acid anhydride and N-alkyl alkylene diamine.

11 Claims, No Drawings

OXIDATION AND CORROSION INHIBITING ADDITIVES FOR RAILWAY DIESEL CRANKCASE LUBRICANTS

BACKGROUND OF INVENTION

1. Field of the Invention

This invention relates to railway diesel lubricants and, more particularly, to diesel fuels containing anti-corrosion and anti-oxidation additives for improving the corrosion inhibition and anti-oxidation properties in motor fuels.

Over the past ten years the price of diesel fuel has increased dramatically. As an example, the price of marine diesel fuel has increased from $11 a metric ton to a high of about $200 a metric ton. Additionally, a similar increase in fuel cost has been experienced by the railroad industry. These increases have resulted in the cost of fuel being the largest expense for the owners of any diesel fleet of vehicles. To try to obtain some relief from this large expense the railroads have embarked on a program of mixing poorer grade fuels (such as marine residual) with the regular D-2 diesel fuel. While they do realize a savings from this mixed fuel operation, other engine performance problems arise, such as increased corrosion and poorer oxidative stability. The proportions of the problems can be observed when one sees General Electric spending $20 million dollars to build new test facilities to evaluate the parameters involved and General Motors (EMD) exerting a similar type of effort to also study the problem.

The present invention deals with the scenario where diesel fuel (D-2) is extended with diesel residual fuel, as proposed by the railway industry. As a result, railway diesel oil (RDO) will be subjected to more severe conditions during operation. We have simulated the scenario wherein RDO is contaminated with a given amount of marine diesel residual fuel. We believe this to be a realistic test since during normal engine operation D-2 gets into the diesel crankcase. We used the Union Pacific Oxidation Test (UPOT) to evaluate the effectiveness of the experimental additives in reducing corrosion and oxidative thickening of the RDO.

2. Disclosure Statement

U.S. Pat. No. 4,419,105 discloses the use of the reaction product of maleic anhydride and certain amines or diamines as corrosion inhibitors in alcohols.

U.S. Pat. No. 4,321,062 discloses the use of the reaction product of maleic anhydride, certain phenols, and certain alkyl-alkylene diamines as a corrosion inhibitor and carburetor detergent additive in motor fuels.

U.S. Pat. No. 4,290,778 discloses the use of the reaction product of a hydrocarbyl alkoxyalkylene diamine and maleic anhydride as a corrosion inhibitor and carburetor detergent additive in motor fuels.

U.S. Pat. No. 4,207,079 discloses the use of the reaction product of maleic anhydride and certain alkyl-alkylene diamines as a corrosion inhibitor and a carburetor detergent additive in motor fuels.

U.S. Pat. No. 4,144,034 discloses the use of the reaction product of a polyether amine and maleic anhydride as a carburetor detergent and corrosion inhibitor in motor fuels.

U.S. Pat. No. 3,773,479 discloses the use of the reaction product of maleic anhydride and alkyl or alkylene amines as a carburetor detergent, corrosion inhibitor, and anti-icing additive in motor fuels.

SUMMARY OF THE INVENTION

We have discovered that the reaction product of polyol dibasic acid anhydride and N-alkyl alkylene diamine, is substantially less susceptible to undesired oxidation during engine operating, and substantially less corrosive to metal engine parts such as copper, iron, steel and lead metal surfaces. And, this reaction product, as an additive, in railway diesel crankcase lubricants provides improved resistance to oxidative deterioration as measured by the change in the lubricating oil viscosity and engine corrosion.

The novel reaction product of the instant invention is obtained by reacting a polyol, and maleic anhydride, and a diamine; the polyol can be represented by the formula:

$$HO-(CH_2CH_2O)_a(\underset{\underset{CH_3}{|}}{C}HCH_2O)_b(CH_2CH_2O)_cH$$

wherein a+c has a value of about 2 to about 80, preferably about 20 to about 40, b has a value of about 10 to about 70, preferably about 20 to about 30. The N-alkyl alkylene diamine has the formula:

$$R'-NH-R''-NH_2$$

where R' is a ($C_8$–$C_{18}$) hydrocarbon group and R'' is a ($C_1$–$C_8$) hydrocarbon group, preferably a ($C_2$–$C_4$) hydrocarbon group.

The dibasic acid anhydrides of the present invention, may be represented by the formula

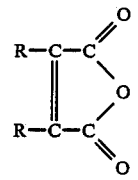

where R is H, $CH_3$— or $C_2H_5$—.

Accordingly, the dibasic acid anhydrides may include the following:

maleic anhydride
alpha-methyl maleic anhydride
alpha-ethyl maleic anhydride
alpha,beta-dimethyl maleic anhydride The preferred dibasic acid anhydride is maleic anhydride.

This invention is also directed to a marine crankcase lubricant composition containing the prescribed reaction product which exhibit substantially reduced oxidation and corrosion tendencies.

DETAILED EMBODIMENTS OF THE INVENTION

The novel reaction product of this invention is prepared by reacting maleic anhydride, a polyol and an N-alkyl-alkylene diamine. The polyol reactant is represented by the formula $$HO-(CH_2CH_2O)_a(\underset{\underset{CH_3}{|}}{C}HCH_2O)_b(CH_2CH_2O)_cH$$

wherein a+c has a value of about 2 to about 80, preferably about 20 to about 40 and more preferably about 70, and b has a value of about 5 to about 70, preferably about 20 to about 30. The molecular weight of the polyol may range from about 800 to about 2000. Examples of the polyols, which may be employed herein, include those listed below in Table I.

TABLE I

A. The Wyandotte Pluronic L-43 brand of poly (oxyethylene) poly (oxypropylene) poly (oxyethylene) polyol having a molecular weight ($\overline{Mn}$) of 1200 and containing 30 wt.% derived from poly (oxyethylene) and 70 wt.% derived from poly (oxypropylene). In this product, b is 16.6 and a+c is 5.5.

B. The Wyandotte Pluronic L-63 brand of poly (oxyethylene) poly (oxypropylene) poly (oxyethylene) polyol having a molecular weight ($\overline{Mn}$) of 1750 and containing 30 wt.% derived from poly (oxyethylene) and 70 wt.% derived from poly (oxypropylene). In this product, b is 21.1 and a+c is 11.9.

C. The Wyandotte Pluronic L-62 brand of poly (oxyethylene) poly (oxypropylene) poly (oxyethylene) polyol having a molecular weight ($\overline{Mn}$) of 1750 and containing 20 wt.% derived from poly (oxyethylene) and 80 wt.% derived from poly (oxypropylene). In this product, b is 24.1 and a+c is 8.

D. The wyandotte Pluronic L-31 brand of poly (oxyethylene) poly (oxypropylene) poly (oxyethylene) polyol having a molecular weight ($\overline{Mn}$) of 950 and containing 10 wt.% derived from poly (oxyethylene) and 90 wt.% derived from poly (oxypropylene). In this product, b is 14.7 and a+c is 2.2

E. The wyandotte Pluronic L-64 brand of ply (oxyethylene) poly (oxypropylene( poly (oxyethylene) polyol having a olecular weight ($\overline{Mn}$) of 1750 and containing 40 wt.% derived from poly (oxyethylene) and 60 wt.% derived from poly (oxypropylene). In this product b is 18.1 and a+c is 15.9.

The amines which may be employed in the present process include polyamines, preferably diamines, which bear at least one primary amine-$NH_2$ group and at least one substituted primary amine group. The latter may be di-substituted but, more preferably, it is mono-substituted. The hydrocarbon nucleous of the amine may be aliphatic or aromatic, including alkyl, alkaryl, aralkyl, aryl, or cyclalkyl in nature. The preferred amine has the formula $$R'—NR—R''—NH_2$$

wherein R' is a ($C_8$–$C_{18}$) hydrocarbon group and R'' is a ($C_1$–$C_8$) hydrocarbon group, preferably a ($C_2$–$C_4$) hydrocarbon group. In the preferred amines, i.e., monosubstituted primary amines, R' may be an alkyl, alkaryl, aralky., aryl, or cycloalkyl hydrocarbon group and R'' may be an alkylene, aralkylene, alkarylene, arylene, or cycloalkylene hydrocarbon group.

Illustrative of the preferred N-primary alkylalkylene diamines may include those listed below in Table II.

TABLE II

A. The Duomeen O brand of N-oleyl-1,3-propane diamine.

B. The Duomeen S brand of N-stearyl-1,3-propane diamine.

C. The Duomeen T brand of N-tallow-1,3-propane diamine.

D. The Duomeen C brand of N-coco-1,3-propane diamine.

The most preferred diamine, R'—NH—R''—$NH_2$, is that where the R'' group is propylene, —$CH_2CH_2CH_2$—, and the R' group is a ($C_{12}$–$C_{18}$) n-alkyl group.

In accordance with the present invention, the process comprises the addition to the hydrocarbon fuel, of a minor deposit-inhibiting amount of, as a deposit-inhibiting additive, a reaction product of (a) a polyol, (b) maleic anhydride, and (c) an N-alkyl-alkylene diamine.

The following example is provided to illustrate the preferred method of preparing the present reaction product and the effectiveness of the product in railway diesel crankcase lubricants. It will be understood that the following example is merely illustrative and not meant to limit the invention in any way.

EXAMPLE

The reaction, i.e., condensate product is prepared by first reacting maleic anhydride with the prescribed polyol. The reaction of about 1 to about 2 mole, preferably about 1 mole maleic anhydride with about 1 to about 2 moles, preferably about 1.0 mole polyol is preferably carried out in the presence of a solvent. Suitable solvents include hydrocarbons boiling in the gasoline boiling range of about 30° C. to about 200° C. Generally, this will include saturated and unsaturated hydrocarbons having from about 5 to about 10 carbon atoms. Specific suitable hydrocarbon solvents include hexane, cyclohexane, benzene, toluene, and mixtures thereof. Xylene is the preferred solvent. The solvent can be present in an amount of up to about 90 percent by weight of the total reaction mixture. The mixture is heated for 2 hours, then cooled to 60° C. and then add 1 mole of N-alkyl alkylene diamine. The mixture is heated at 100° C. for 2 more hours, whereupon it is filtered and stripped under vacuum.

In a preferred method for preparing the reaction product, the 1 mole maleic anhydride and 1 mole of Pluronic L-43 are combined with the solvent xylene and reacted at a temperature of about 100° C. The reaction mixture is maintained at this temperature for approximately 2 hours. The mixture is then cooled to about 60° C., whereupon the 1 mole of Duomeen-T is added. The new mixture is then reacted at about 100° C. for approximately 2 hours. The reaction product can then be separated from the solvent, using convention means or left in admixture with some or all of the solvent, to facilitate addition of the reaction product to diesel or other diesel lubricants, e.g., marine diesel lubricant. The final reaction product (E) structure (as evidenced by elemental analysis, IR analysis, and NMR analysis) is shown in the illustration below.

In the process illustrated below, initially, maleic anhydride (A) is reacted with a polyol (B) to form an ester of maleic acid (C) then, the ester of maleic acid (C) is reacted with an N-alkyl alkylene diamine (D) to form the condensate produce (E) of a polyol, maleic anhydride and an N-alkyl alkylene diamine. Accordingly, the condensate product (E) is recovered.

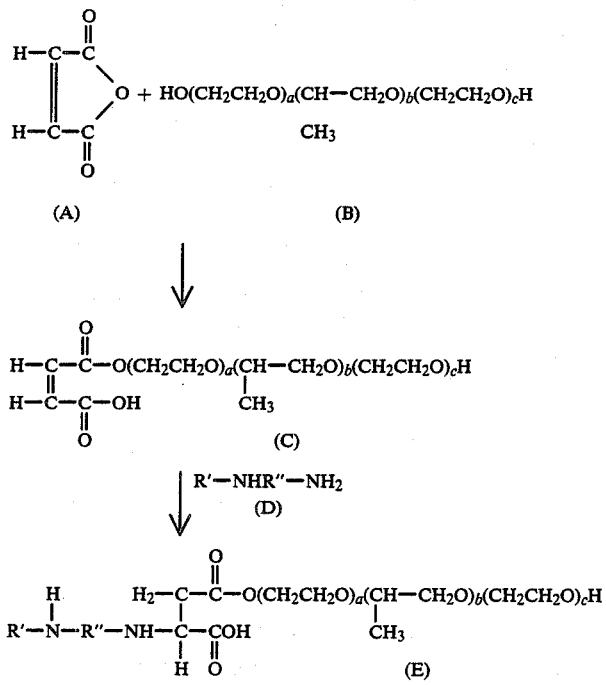

Wherein a+c has a value of about 2 to about 80, preferably about 20 to about 40 and more preferably about 70, and b has a value of from about 5 to about 70, preferably about 20 to about 30; R' is a ($C_8$–$C_{18}$) alkyl, alkaryl, aralkyl, aryl or cycloalkyl hydrocarbon group, and R" is a ($C_1$–$C_8$) alkylene, aralkylene, alkaraylene, or cycloalkylene hydrocarbon group.

The preferred components of the railway diesel crankcase lubricating oil composition of the present invention are those which are effective in a range of from about 0.1 to about 5.0 wt.% based on the total lubricating oil composition. However, it is preferred to employ from about 0.5 to about 2.0 wt.% of the derivative based on the weight of the lubricating oil with the most preferred concentration ranging from about 0.75 to about 1.5 wt.%.

The railway diesel crankcase lubricating oil composition, in other words, comprises (a) a major portion of a liquid paraffinic mineral oil having a viscosity at 100° C. of about 52.5 SUS minimum, a paraffinic mineral oil having a viscosity at 100° C. of about 75.0 to about 79.0 SUS and a liquid naphthenic mineral oil having a viscosity at 100° C. of about 75.0 to about 80.0 SUS, and (b) a minor amount of, as an oxidation and corrosion inhibiting agent, a condensate product prepared (as described above) from the reaction of a polyol, maleic anhydride and an N-alkyl alkylene diamine.

The second essential component of the railway diesel crankcase lubricating oil composition of the instant invention is an overbased calcium alkylphenolate, a phenate or a sulfurized overbased calcium alkylphenolate in a sufficient amount to provide a Total Base Number (TBN) ranging from about 3 to about 13 in the finished railway diesel crankcase lubricating oil composition. The increase in viscosity is a measure of the oxidation increase and the metal weight loss is a measure of the corrosion deterioration.

OIL OXIDATION TEST

The test method involves bubbling 5 liters of oxygen per hour through 300 mls. of test oil composition at 285° F. in which there is immersed a 1×3×0.06 inch steel backed copper-lead test specimen, cut from bearing stock. The viscosity of the test oil is measured before and after the 144 hour test period and greater the difference in viscosity, the greater the oxidative deterioration of the instant invention. In addition, the test specimen is weighed before and after the test period and the greater the weight loss of test specimen the greater the corrosion deterioration of the test formulation. Further, the larger the amount of copper, iron and lead moieties found in the oil after test, the greater the oxidative/corrosion deterioration thereof.

The representative Formulations A,B and comparative Formulation C and their oxidation test results are reported below in Table III.

TABLE III

| Oil Code Identification Composition, wt. % | A | B | C |
|---|---|---|---|
| Overbased Ca alkaryl sulfonate/phenate(1) | 4.10 | 4.10 | 4.10 |
| Ca Salt of poly-isobutenyl phenol-aldehyde-amine reaction product | 1.46 | 1.46 | 1.46 |
| Polyisobutylene | 0.44 | 0.44 | 0.44 |
| Branched alkyl ($C_{16}$) phenol | 0.88 | 0.88 | 0.88 |
| Chlorowax | 0.15 | 0.15 | 0.15 |
| SNO-320(2) | 19.64 | 19.64 | 20.14 |
| SNO-850(3) | 30.02 | 30.02 | 30.52 |
| 75/80 Pale Oil(4) | 37.31 | 37.31 | 37.31 |
| Low quality marine diesel fuel(5) | 5.00 | 5.00 | 5.00 |
| Experimental anti-oxidation, anti-corrosion additive(6) | 1 | | |
| Experimental anti-oxidation anti-corrosion additive(7) | | 1 | |
| Test Results | | | |
| wt. loss, gm | 0.0078 | 0.0903 | 0.2574 |

TABLE III-continued

| Oil Code<br>Identification Composition, wt. % | A | B | C |
|---|---|---|---|
| % viscosity increase | 24.2 | 50.1 | 82.0 |

(1)The ratio of sulfonate to phenate is 1:1.
(2)A paraffinic mineral oil having a 40° C. viscosity in the range of 308–350 SUS and a 100° C. viscosity of 52.5 SUS minimum.
(3)A paraffinic mineral oil having a 40° C. viscosity in the range of 800–890 SUS and a 100° C. viscosity in the range of 75.0–79.0 SUS.
(4)A naphthenic pale oil having a 100° C. viscosity in the range of 75–80 SUS.
(5)Low quality marine diesel fuel. (See Attachment I below for specifications).
(6)Reaction product of Pluronic L-43, maleic anhydride and N—tallow-1,3-propane diamine.
(7)Reaction product of Pluronic L-43, maleic anhydride and N—coco-1,3-propane diamine.

ATTACHMENT I

| | |
|---|---|
| Density, g/ml 15° C. | 0.962 |
| Viscosity, CST at 50° C. | 173 |
| Water content, O/O V/V | 0.0 |
| Conradson: Carbon residue, O/O M/M | 12.7 |
| Sulphur: O/O M/M | 1.47 |
| Ash, O/O M/M | 0.06 |
| Vandium: MG/KG | 30 |
| Sodium, MG/KG | 120 |
| Allminium, MG/KG | 16 |
| Silicon, MG/KG | 38 |
| Compatability with MGO | No. 1 |
| Calc. lower heat value, MJ/KG | 40.63 |

We claim:

1. A railway diesel crankcase lubricant composition comprising a major portion of a diesel lubricating oil and a minor amount of, as an oxidation and corrosion inhibiting agent, a condensate product prepared by the process comprising:

(i) reacing a dibasic acid anhydride of the formula

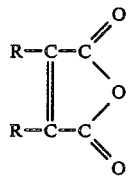

where R is H, $CH_3$— or $C_2H_5$—, with a polyol of the formula $$HO-(CH_2CH_2O)_a(\underset{\underset{CH_3}{|}}{CH_2CH_2O})_b(CH_2CH_2O)_cH$$

where a+c has a value of about 2 to about 80 and b has a value of about 5 to about 70; thereby forming an ester of maleic acid;

(ii) reacting said ester of maleic acid with an N-alkyl alkylene diamine, thereby forming the condensate product; and (iii) recovering said condensate product.

2. The railway diesel crankcase lubricant composition of claim 1, wherein said polyol has a molecular weight ($\overline{M}n$) ranging from about 800 to about 2000.

3. The railway diesel crankcase lubricant composition of claim 1, wherein said polyol is reacted with a dibasic acid anhydride.

4. The railway diesel crankcase lubricant composition of claim 1, wherein said N-alkyl alkylene diamine has the formula $$R'-NH-R''-NH_2$$

where R' is a ($C_8$–$C_{18}$) hydrocarbon group and R'' is a ($C_1$–$C_8$) hydrocarbon group.

5. The railway diesel crankcase lubricant of claim 4, where R'' is a ($C_2$ to $C_4$) hydrocarbon group.

6. The railway diesel crankcase lubricant composition of claim 1, wherein the minor amount of oxidation and corrosion inhibiting agent ranges from about 0.1 to about 5.0 weight percent of said lubricant composition.

7. The railway diesel crankcase lubricant composition of claim 6, wherein the minor amount of inhibiting agent ranges from about 0.5 to about 2.0 wt.% of said lubricant composition.

8. The railway diesel crankcase lubricant composition of claim 7, wherein the minor amount of inhibiting agent ranges from about 0.75 to about 1.5 to wt.% of said lubricant composition.

9. The railway diesel crankcase lubricant composition of claim 1, wherein said lubricant composition includes an overbased calcium alkylphenolate, a phenate or a sulfurized overbased calcium alkylphenolate in a sufficient amount to have a Total Base Number ranging from about 3 to about 13.

10. A railway diesel crankcase lubricant composition comprising:

(a) a major portion of a liquid paraffinic mineral oil having a viscosity at 100° C. of about 52.5 SUS minimum, a paraffinic mineral oil having a viscosity at 100° C. of about 75.0 to about 79.0 SUS and a liquid naphthenic mineral oil having a viscosity at 100° C. of about 75.0 to about 80.0 SUS, (b) a minor amount of, as an oxidation and corrosion inhibiting agent, a condensate product of the process comprising:

(i) reacting a polyol $$HO-(CH_2CH_2O)_a(\underset{\underset{CH_3}{|}}{CHCH_2O})_b(CH_2CH_2O)_cH$$

where a+c has a value of about 2 to about 80 and b has a value of about 5 to about 70, with a dibasic acid anhydride of the formula

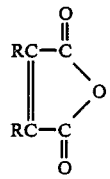

where R is H, $CH_3$— or $C_2H_5$—, thereby forming an ester of maleic acid;

(ii) reacting said ester of maleic acid with an N-alkyl alkylene diamine $$R'-NH-R''-NH_2$$

where R' is a ($C_8$–$C_{18}$) hydrocarbon group and R'' is a ($C_1$–$C_8$) hydrocarbon group, thereby forming a condensate product

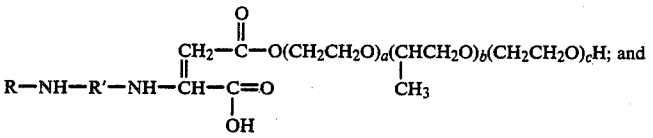

(iii) recovering said condensate product.

11. A diesel crankcase lubricant composition comprising:

(a) a major portion of a liquid paraffinic mineral oil having a viscosity at 100° C. of about 52.5 SUS minimum, a paraffinic mineral oil having a viscosity at 100° C. of about 75.0 to about 79.0 SUS and a liquid maphthenic mineral oil having a viscosity at 100° C. of about 75.0 to about 80.0 SUS, (b) about 1 wt.% of an oxidation and corrosion inhibiting condensate product of the process comprising:

(i) reacting a dibasic acid anhydride of the formula

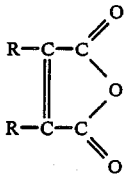

where R is H, $CH_3$— or $C_2H_5$—, with a polyol of the formula

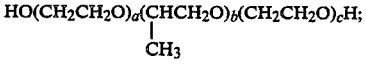

where a+c has a value of about 2 to about 80 and b has a value of about 5 to about 70, thereby forming an ester of maleic acid

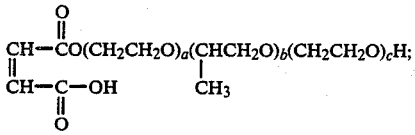

(ii) reacting said ester of maleic acid with N-tallow-1,3-propane diamine, thereby forming a said condensate product

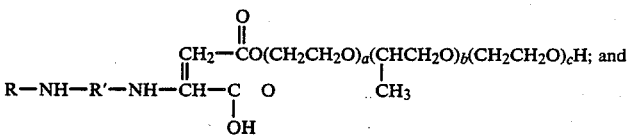

(iii) recovering said condensate product.

* * * * *